US011078429B2

(12) United States Patent
Stephens et al.

(10) Patent No.: US 11,078,429 B2
(45) Date of Patent: Aug. 3, 2021

(54) BURNER, FURNACE, AND STEAM CRACKING PROCESSES USING THE SAME

(71) Applicant: ExxonMobil Chemical Patents Inc., Baytown, TX (US)

(72) Inventors: George Stephens, Tokyo (JP); David B. Spicer, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 0 days.

(21) Appl. No.: 16/787,757

(22) Filed: Feb. 11, 2020

(65) Prior Publication Data

US 2020/0172815 A1 Jun. 4, 2020

Related U.S. Application Data

(62) Division of application No. 15/378,462, filed on Dec. 14, 2016.

(60) Provisional application No. 62/316,246, filed on Mar. 31, 2016.

(30) Foreign Application Priority Data

May 19, 2016 (EP) ..... 16170266

(51) Int. Cl.

| | |
|---|---|
| ***C10G 9/20*** | (2006.01) |
| ***C10G 9/36*** | (2006.01) |
| ***F23C 5/00*** | (2006.01) |
| ***F23C 5/08*** | (2006.01) |
| ***F23C 9/00*** | (2006.01) |
| ***F23M 5/02*** | (2006.01) |
| ***F23D 14/08*** | (2006.01) |
| ***F23D 14/70*** | (2006.01) |

(52) U.S. Cl.

CPC ..... *C10G 9/20* (2013.01); *C10G 9/36* (2013.01); *F23C 5/00* (2013.01); *F23C 9/006* (2013.01); *F23D 14/08* (2013.01); *F23D 14/70* (2013.01); *F23M 5/025* (2013.01); *C10G 2300/4075* (2013.01); *C10G 2300/807* (2013.01); *F23C 2202/30* (2013.01); *F23C 2900/09001* (2013.01); *F23C 2900/9901* (2013.01)

(58) Field of Classification Search

CPC ..... C10G 9/20; C10G 9/36; F23C 5/00; F23C 5/08; F23C 9/006; F23M 5/025

See application file for complete search history.

(56) References Cited

U.S. PATENT DOCUMENTS 6,884,062 B2 * 4/2005 Stephens ..... F23C 6/045 126/91 A

* cited by examiner

*Primary Examiner* — Randy Boyer

(57) ABSTRACT

A burner sub-system, a furnace comprising the same, a fuel combustion process and steam cracking process carried out in the furnace. The burner sub-system comprises a barrier wall segment between the burner tip and the flue-gas recirculation ("FGR") duct, effectively blocking direct gas flow between the burner tip and the FGR duct opening, but without encircling the whole burner tip. The presence of the partial barrier wall has the advantage of preventing the temperature inside the FGR duct from becoming too high, while achieving low NOx emissions from the combustion process without overheating the burner tip because of reduced amount of heat reflection to the burner tip compared to an annular barrier wall. The invention is particularly useful in furnaces where hydrogen-rich fuel gas is combusted.

15 Claims, 15 Drawing Sheets

BURNER, FURNACE, AND STEAM CRACKING PROCESSES USING THE SAME

CROSS-REFERENCE

This is a divisional of U.S. patent application Ser. No. 15/378,462 filed, Dec. 14, 2016, which claims priority to and the benefit of U.S. Patent Application Ser. No. 62/316,246, filed Mar. 31, 2016, and European Patent Application No. 16170266.7 filed May 19, 2016, which are incorporated by reference herein.

TECHNICAL FIELD

This invention relates to burners, furnaces, fuel combustion processes using the same, and steam cracking processes using the same. In particular, it relates to burner sub-systems capable of burning fuel gas rich in hydrogen, furnaces comprising the same, hydrogen-rich fuel gas combustion processes using the same, and steam cracking processes using the same.

BACKGROUND

In gas fired industrial furnaces, $NO_x$ is formed by the oxidation of nitrogen drawn into the burner with the combustion air stream. The formation of $NO_x$ is widely believed to occur primarily in regions of the flame where there exist both high temperatures and an abundance of oxygen. Since ethylene furnaces are amongst the highest temperature furnaces used in the hydrocarbon processing industry, the natural tendency of burners in these furnaces is to produce high levels of $NO_x$ emissions.

The majority of recent low $NO_x$ burners for gas-fired industrial furnaces are based on the use of multiple fuel jets in a single burner. Such burners may employ fuel staging, flue-gas recirculation ("FGR"), or a combination of both. U.S. Pat. Nos. 5,098,282 and 6,007,325 disclose burners using a combination of fuel staging and flue-gas recirculation. Certain burners may have as many as 8-12 fuel nozzles in a single burner. The large number of fuel nozzles require the use of very small diameter nozzles. In addition, the fuel nozzles of such burners are generally exposed to the high temperature flue-gas in the firebox.

One technique for reducing $NO_x$ that has become widely accepted in industry is known as staging. With staging, the primary flame zone is deficient in either air (fuel-rich) or fuel (fuel-lean). The balance of the air or fuel is injected into the burner in a secondary flame zone or elsewhere in the combustion chamber. As is well known, a fuel-rich or fuel-lean combustion zone is less conducive to $NO_x$ formation than an air-fuel fuel ratio closer to stoichiometry. Combustion staging results in reducing peak temperatures in the primary flame zone and has been found to alter combustion speed in a way that reduces $NO_x$. Since $NO_x$ formation is exponentially dependent on gas temperature, even small reductions in peak flame temperature dramatically reduce $NO_x$ emissions. However this is generally balanced with the fact that radiant heat transfer decreases with reduced flame temperature, while CO emissions, an indication of incomplete combustion, may actually increase.

In the context of premix burners, the term primary air refers to the air premixed with the fuel; secondary, and in some cases tertiary, air refers to the balance of the air required for proper combustion. In raw gas burners, primary air is the air that is more closely associated with the fuel; secondary and tertiary air is more remotely associated with the fuel. The upper limit of flammability refers to the mixture containing the maximum fuel concentration (fuel-rich) through which a flame can propagate.

U.S. Pat. No. 4,629,413 discloses a low $NO_x$ premix burner and discusses the advantages of premix burners and methods to reduce $NO_x$ emissions. The premix burner of U.S. Pat. No. 4,629,413 lowers $NO_x$ emissions by delaying the mixing of secondary air with the flame and allowing some cooled flue gas to recirculate with the secondary air. The manner in which the burner disclosed achieves light off at start-up and its impact on $NO_x$ emissions is not addressed. The contents of U.S. Pat. No. 4,629,413 are incorporated by reference in their entirety.

U.S. Pat. No. 5,092,761 discloses a method and apparatus for reducing $NO_x$ emissions from premix burners by recirculating flue gas. Flue gas is drawn from the furnace through recycle ducts by the inspirating effect of fuel gas and combustion air passing through a venturi portion of a burner tube. Airflow into the primary air chamber is controlled by dampers and, if the dampers are partially closed, the reduction in pressure in the chamber allows flue gas to be drawn from the furnace through the recycle ducts and into the primary air chamber. The flue gas then mixes with combustion air in the primary air chamber prior to combustion to dilute the concentration of oxygen in the combustion air, which lowers flame temperature and thereby reduces $NO_x$ emissions. The flue-gas recirculating system may be retrofitted into existing burners or may be incorporated in new low $NO_x$ burners. The entire contents of U.S. Pat. No. 5,092,761 are incorporated herein by reference.

A drawback of the system of U.S. Pat. No. 5,092,761 is that the staged-air used to cool the FGR duct first enters the furnace firebox, traverse a short distance across the floor and then enter the FGR duct. During this passage, the staged air is exposed to radiation from the hot flue-gas in the firebox. Analyses of experimental data from burner tests suggest that the staged-air may be as hot as 700° F. when it enters the FGR duct.

From the standpoint of $NO_x$ production, another drawback associated with the burner of U.S. Pat. No. 5,092,761 relates to the configuration of the lighting chamber, necessary for achieving burner light off. The design of this lighting chamber, while effective for achieving light off, has been found to be a localized source of high $NO_x$ production during operation. Other burner designs possess a similar potential for localized high $NO_x$ production, since similar configurations are known to exist for other burner designs, some of which have been described hereinabove.

Additionally, commercial experience and modeling have shown when flue-gas recirculation rates are raised, there is a tendency of the flame to be drawn into the FGR duct. Often, it is this phenomenon that constrains the amount of flue-gas recirculation. When the flame enters directly into the flue-gas recirculation duct, the temperature of the burner venturi tends to rise, which raises flame speed and causes the recirculated flue gas to be less effective in reducing $NO_x$. From an operability perspective, the flue-gas recirculation rate needs to be lowered to keep the flame out of the FGR duct to preserve the life of the metallic FGR duct.

U.S. Pat. No. 6,877,980 discloses a burner for use in furnaces such as those used in steam cracking with increased FGR recirculation rate and low NOx formation. The burner includes a primary air chamber; a burner tube having an upstream end, a downstream end and a venturi intermediate said upstream and downstream ends, said venturi including a throat portion having substantially constant internal cross-sectional dimensions such that the ratio of the length to maximum internal cross-sectional dimension of said throat portion is at least 3; a burner tip mounted on the downstream end of said burner tube adjacent a first floor burner opening in the furnace, so that combustion of the fuel takes place downstream of said burner tip; and a fuel orifice located adjacent the upstream end of said burner tube, for introducing fuel into said burner tube. In the burner disclosed therein, a circular barrier wall is erected surrounding the floor burner opening, blocking the base of the floor burner flame from the flue-gas recirculation duct ports on the floor. The barrier wall serves the purpose of stabilizing the flame and reducing NOx formation.

It has been recently found that, however, the annular barrier wall in the burner of U.S. Pat. No. 6,877,980 also reflects the heat produced by the flame to the burner tip, thereby increasing the burner tip temperature. Where the fuel gas comprises primarily hydrocarbons such as methane, the burner tip temperature is generally reasonably low to provide a satisfactory life, even with the reflected heat from the barrier wall. However, where the fuel gas comprises primarily hydrogen (i.e., comprising at least 50 mol % of hydrogen), the flame speed and flame temperature are significantly higher, and so is the amount of heat reflected by the barrier wall to the burner tip. As a result, the burner tip is frequently overheated to an exceedingly high temperature, leading to premature failure, especially during burner turndown process or flame flash-back.

Therefore, there is a need for an improved burner sub-system design with reduced overheating potential, especially when hydrogen-rich fuel gas is used. The present invention satisfies this and other needs.

SUMMARY

It has been found that, by employing a barrier wall segment between the floor burner opening and the FGR duct opening capable of blocking direct gas flow between these two, in whole or in part, instead of a annular barrier wall surrounding the entirety of the floor burner opening, one can effectively reduce the amount of heat reflected to the burner tip, resulting in a lower burner tip temperature enabling satisfactory life thereof, even when hydrogen-rich fuel gas is used. A burner sub-system including such barrier segment can achieve a high level of FGR rate, a relatively low temperature inside the FGR, a low level of NOx emissions, without decreasing flame stability. Such a burner sub-system can be advantageously used in hydrocarbon steam cracking furnaces.

Thus, a first aspect of the present invention relates to burner sub-system comprising: (a1) a furnace floor segment having a floor burner opening and a flue-gas recirculation duct opening; (a2) a tile enclosure lining the periphery of the floor burner opening; (a3) a burner comprising a burner tip adjacent and surrounded by the floor burner opening, the burner tip configured to provide a floor burner flame through the floor burner opening and having a vertical centerline; (a4) a flue-gas recirculation duct opening adjacent the tile enclosure; and (a5) a barrier wall segment extending upwards from the upper surface of the furnace floor segment between the flue-gas recirculation duct opening and the burner tip, the barrier wall segment having an angle of view no greater than 180° when viewed from the point where the vertical centerline of the burner tip intercepts a plane of the furnace floor segment.

A second aspect of the present invention relates to a furnace comprising: (b1) at least one burner sub-system according to the first aspect of the present invention; (b2) a furnace floor comprising each of the furnace floor segment of the at least one burner sub-system; and (b3) one or more furnace side walls; wherein the furnace floor and the one or more furnace side walls form a furnace fire box.

A third aspect of the present invention relates to a fuel combustion process carried out in a furnace according to the second aspect of the present invention, the process comprising: (c1) supplying a fuel gas comprising at least 50 mol % of hydrogen into the at least one burner sub-system; and (c2) combusting the fuel gas to form a floor burner flame above the burner tip inside the furnace fire box.

A fourth aspect of the present invention relates to a steam cracking process comprising a fuel combustion process of the third aspect of the present invention, wherein a reactant stream comprising a hydrocarbon is heated inside a cracking tube which is heated inside the furnace by the flame.

These and other features of the present invention will be apparent from the detailed description taken with reference to accompanying drawings.

BRIEF DESCRIPTION OF THE DRAWINGS

The invention is further explained in the description that follows with reference to the drawings illustrating, by way of non-limiting examples, various embodiments of the invention wherein.

DETAILED DESCRIPTION

Figure 1:
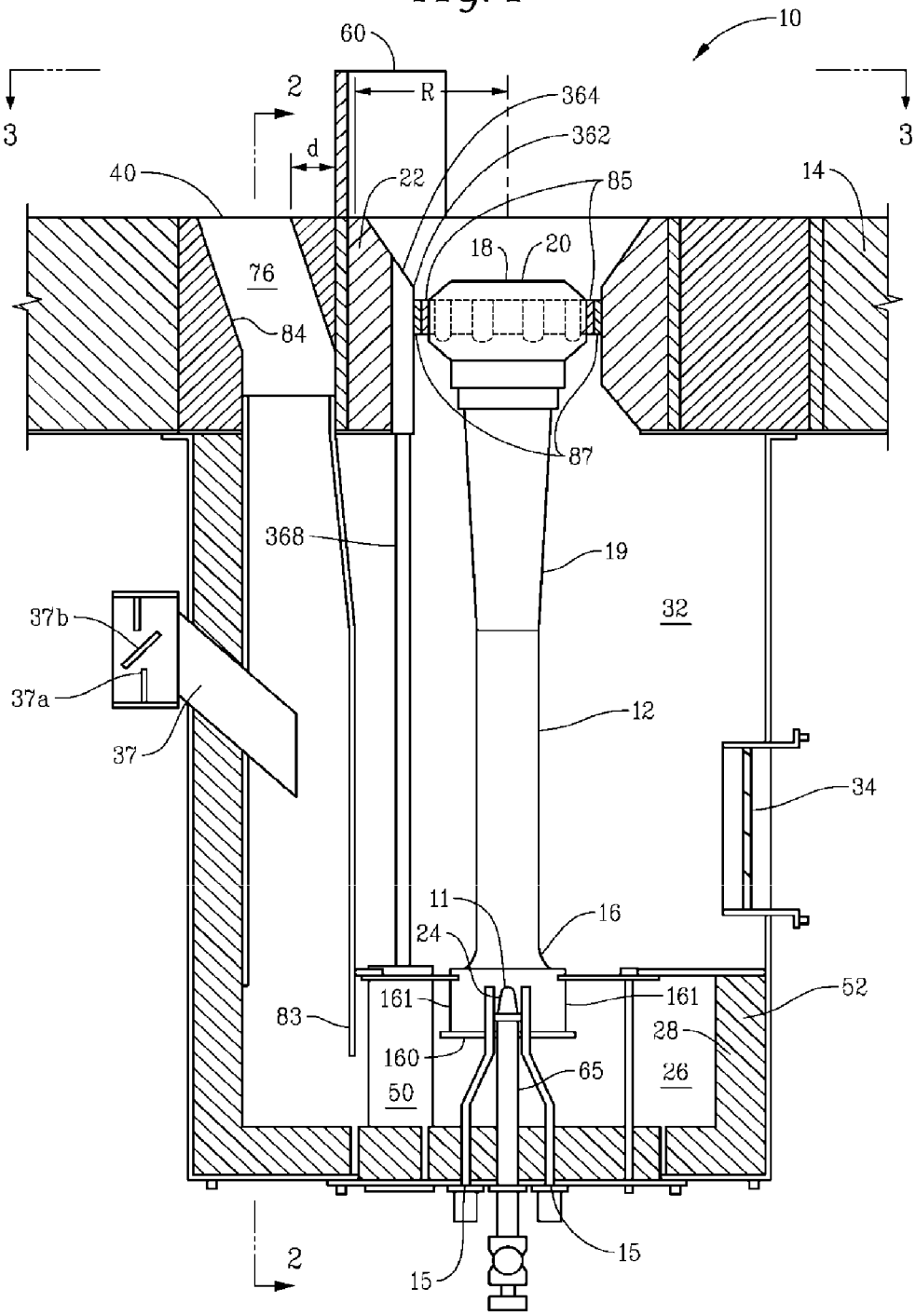
FIG. 1 illustrates an elevation partly in section of an example of the burner sub-system of the present invention.

Although the present invention is described in terms of a burner sub-system for use in connection with a furnace or an industrial furnace, it will be apparent to one of skill in the art that the teachings of the present invention also have applicability to other process components such as, for example, boilers. Thus, the term furnace herein shall be understood to mean furnaces, boilers and other applicable process components.

As used herein, a "hydrogen-rich" gas is a gas comprising at least 50 mol % of molecular hydrogen. Hydrogen-rich fuel gas comprising at least 50, 55, 60, 65, 70, 75, 80, 85, 90, 95, 98, or even 99 mol % of molecular hydrogen has become more readily available than before due to, inter alia, steam cracking of saturated hydrocarbon (ethane, propane, butanes, and the like) to make olefins. Such hydrogen-rich fuel gas may comprise, in addition to molecular hydrogen, hydrocarbons such as methane, ethane, propane, butanes, and the like. Flames produced from burning hydrogen-rich fuel gas tend to have higher flame speed than those produced from natural gas. Higher flame speed tends to cause the flame to attach more closely to the burner tip resulting in higher burner tip temperature. As a result, thermal management of burners burning hydrogen-rich fuel gas is more important than those burning natural gas.

Referring to the examples of burner sub-systems illustrated in FIGS. 1-4, a burner sub-system 10 includes a freestanding burner tube 12 located in a well ending with a floor burner opening in a furnace floor segment 14. The burner tube 12 includes an upstream end 16, a downstream end 18 and a venturi portion 19. A burner tip 20 is located at the downstream end 18 and is surrounded by an annular tile enclosure 22. A fuel orifice 11, which may be located within fuel spud 24, is located at the top end of a gas fuel riser 65 and is located at the upstream end 16 of tube 12 and introduces fuel into the burner tube 12. Fresh or ambient air is introduced into a primary air chamber 26 through an adjustable damper 37*b* to mix with the fuel at the upstream end 16 of the burner tube 12 and pass upwardly through the venturi portion 19. Combustion of the fuel and fresh air occurs downstream of the burner tip 20.

Multiple air ports 30 (FIGS. 2 and 3) originate in a secondary air chamber 32 and pass through the furnace floor segment 14 into the furnace. Fresh or ambient air enters the secondary air chamber 32 through adjustable dampers 34 and passes through the staged air ports 30 into the furnace to provide secondary or staged combustion.

In order to recirculate flue gas from the furnace to the primary air chamber, FGR duct 76 extends from FGR duct opening 40, in the floor of the furnace into the primary air chamber 26. Alternatively, multiple passageways (not shown) may be used instead of a single passageway. Flue gas is drawn through FGR duct 76 by the inspirating effect of fuel passing through venturi 19 of burner tube 12. In this manner, the primary air and flue gas are mixed in primary air chamber 26, which is prior to the zone of combustion. Therefore, the amount of inert material mixed with the fuel is raised, thereby reducing the flame temperature, and as a result, reducing $NO_x$ emissions. Closing or partially closing damper 37*b* restricts the amount of fresh air that can be drawn into the primary air chamber 26 and thereby provides the vacuum necessary to draw flue gas from the furnace floor.

Mixing is promoted by providing two or more primary air channels 37 and 38 protruding into the FGR duct 76. The channels 37 and 38 are conic-section, cylindrical, or squared and a gap between each channel 37 and 38 produces a turbulence zone in the FGR duct 76 where good flue gas/air mixing occurs.

The geometry of channels 37 and 38 is designed to promote mixing by increasing air momentum into the FGR duct 76. The velocity of the air is optimized by reducing the total flow area of the primary air channels 37 and 38 to a level that still permits sufficient primary air to be available for combustion, as those skilled in the art are capable of determining through routine trials.

Mixing is further enhanced by a plate member 83 at the lower end of the inner wall of the FGR duct 76. The plate member 83 extends into the primary air chamber 26. Flow eddies are created by flow around the plate of the mixture of flue gas and air. The flow eddies provide further mixing of the flue gas and air. The plate member 83 also makes the FGR duct 76 effectively longer, and a longer FGR duct also promotes better mixing.

The improvement in the amount of mixing between the recirculated flue gas and the primary air caused by the channels 37 and 38 and the plate member 83 results in a higher capacity of the burner to inspirate flue-gas recirculation and a more homogeneous mixture inside the venturi portion 19. Higher flue-gas recirculation reduces overall flame temperature by providing a heat sink for the energy released from combustion. Better mixing in the venturi portion 19 tends to reduce the hot-spots that occur as a result of localized high oxygen regions.

Unmixed low temperature ambient air (primary air), is introduced through angled channels 37 and 38, each having a first end comprising an orifice 37*a* and 38*a*, controlled by damper 37*b*, and a second end comprising an orifice which communicates with FGR duct 76. The ambient air so introduced is mixed directly with the recirculated flue gas in FGR duct 76. The primary air is drawn through channels 37 and 38, by the inspirating effect of the fuel passing through the fuel orifice, which may be contained within gas spud 24. The ambient air may be fresh air as discussed above.

Additional unmixed low temperature ambient air, having entered secondary air chamber 32 through dampers 34 is drawn through orifice 62, through bleed air duct 64, through orifice 97 into FGR duct 76 and into the primary air chamber 26 by the inspirating effect of the fuel passing through venturi portion 19. The ambient air may be fresh air as discussed above. The mixing of the cool ambient air with the flue gas lowers the temperature of the hot flue gas flowing through FGR duct 76 and thereby substantially increases the life of FGR duct 76 and allows use of this type of burner to reduce $NO_x$ emission in high temperature cracking furnaces having flue gas temperature above 1900° F. in the radiant section of the furnace. Bleed air duct 64 has a first end 66 and a second end 68, first end 66 connected to orifice 62 of secondary air chamber 32 and second end 68 connected to orifice 97 of FGR duct 76.

Additionally, a minor amount of unmixed low temperature ambient air, relative to that amount passing through bleed air duct 64, having passed through air ports 30 into the furnace, may also be drawn through FGR duct 76 into primary air chamber 26 by the inspirating effect of the fuel passing through venturi portion 19. To the extent that damper 37*b* is completely closed, bleed air duct 64 is desirably sized so as to permit the necessary flow of the full requirement of primary air needed by burner 10.

The flue-gas recirculated to the burner is mixed with a portion of the cool staged air in the FGR duct 76. This mixing reduces the temperature of the stream flowing in the FGR duct 76, and enables readily available materials to be used for the construction of the burner. This feature is useful for the burners of high temperature furnaces such as steam crackers or reformers, where the temperature of the flue-gas being recirculated can be as high as 1900° F.-2100° F. By combining approximately one pound of staged-air with each pound of flue-gas recirculated, the temperature within the FGR duct can be advantageously reduced.

One or more passageways connecting the secondary air chamber directly to the flue-gas recirculation duct induce a small quantity of low temperature secondary air into the FGR duct 76 to cool the air/flue-gas stream entering in the metallic section of the FGR duct 76. By having the majority of the secondary air supplied directly from the secondary air chamber, rather than having the bulk of the secondary air traverse across the furnace floor prior to entering the FGR duct, beneficial results are obtained, as demonstrated by the Examples below.

Advantageously, a mixture of from about 20% to about 80% flue gas and from about 20% to about 80% ambient air is drawn through FGR duct 76. It is particularly preferred that a mixture of about 50% flue gas and about 50% ambient air be employed. The desired proportions of flue gas and ambient air may be achieved by proper sizing, placement and/or design of FGR duct 76, bleed air ducts 64 and air ports 30, as those skilled in the art will readily recognize. That is, the geometry and location of the air ports and bleed air ducts may be varied to obtain the desired percentages of flue gas and ambient air.

A sight and lighting port 50 is provided in the primary chamber 26, both to allow inspection of the interior of the burner assembly, and to provide access for lighting of the burner 10 with lighting element (not shown). The burner plenum may be covered with mineral wool or ceramic fiber insulation 52 and wire mesh screening (not shown) to provide insulation therefor. The lighting chamber 99 is located at a distance from burner tip 20 effective for burner light off. A lighting torch or igniter (not shown) of the type disclosed in U.S. Pat. No. 5,092,761 has utility in the start-up of the burner. To operate the burner, the torch or igniter is inserted through light-off port 50 into the lighting chamber 99, which is adjacent burner tip 20, to light the burner 10.

In operation, fuel orifice 11, which may be located within gas spud 24, discharges fuel into burner tube 12, where it mixes with primary air, recirculated flue gas or mixtures thereof. The mixture of fuel, recirculated flue-gas and primary air then discharges from burner tip 20. The mixture in the venturi portion 19 of burner tube 12 is maintained below the fuel-rich flammability limit; i.e. there is insufficient air in the venturi to support combustion. Secondary air is added to provide the remainder of the air required for combustion.

In addition to the use of flue gas as a diluent, another technique to achieve lower flame temperature through dilution is through the use of steam injection. Steam can be injected in the primary air or the secondary air chamber. Steam may be injected through one or more steam injection tubes 15, as shown in FIG. 1. Preferably, steam is injected upstream of the venturi.

The cross-section of FGR duct 76 is substantially rectangular, typically with its minor dimension ranging from 30% to 100% of its major dimension. Conveniently, the cross sectional area of FGR duct 76 ranges from about 5 square inches to about 12 square inches/million (MM) Btu/hr burner capacity and, in a practical example, from 34 square inches to 60 square inches. In this way the FGR duct 76 can accommodate a mass flow rate of at least 100 pounds per hour per MM Btu/hr burner capacity, preferably at least 130 pounds per hour per MM Btu/hr burner capacity, and still more preferably at least 200 pounds per hour per MM Btu/hr burner capacity. Moreover, FGR ratios of greater than 10% and up to 15% or even up to 20% can be achieved.

With reference to FIGS. 1-3 and FIG. 12 and in one example of the present invention, a barrier wall segment 60 between burner tip 20 mounted on the downstream end 18 of the burner tube 12 and the FGR duct opening 40 to provide a barrier between a base of a flame downstream of the burner tip 20 and the FGR duct opening 40. The barrier wall segment 60 blocks direct gas flow between the burner floor opening and the FGR duct opening, thereby reducing the temperature inside the FGR duct, the NOx formation in the furnace, and increasing the stability of the flame.

Figure 12:
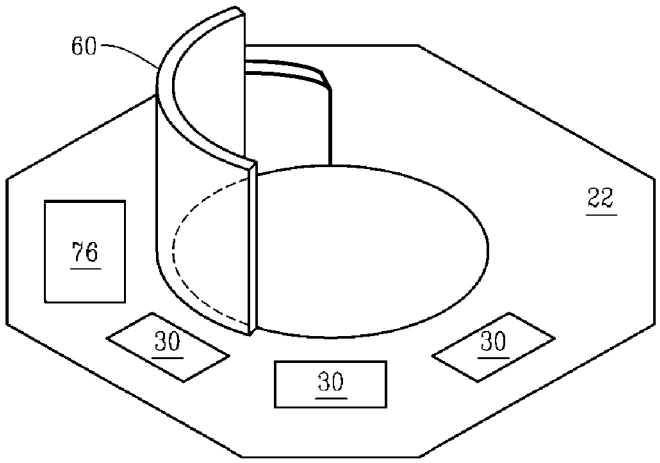
FIG. 12 is a perspective view of a barrier wall segment in accordance with one example of the burner sub-system of present invention.
Figure 12A:
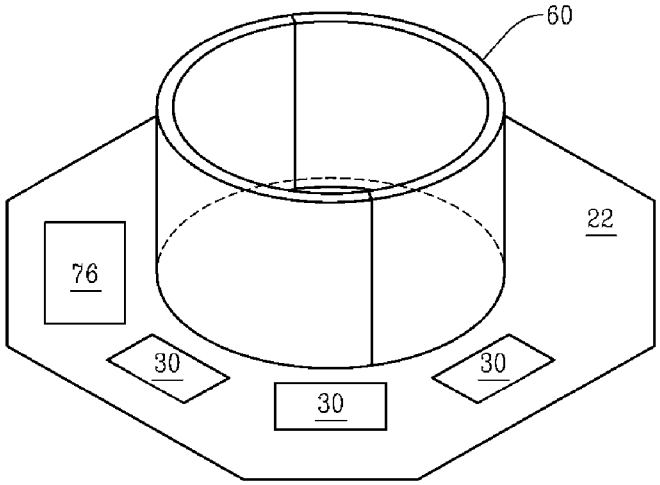
FIG. 12A is a perspective view of an annular barrier wall in the prior art.

U.S. Pat. No. 6,877,980 B2 discloses a substantially similar burner sub-system (shown in FIG. 12A) with the distinction of the presence of an annular barrier wall between the burner tip and FGR duct opening and the air ports. The annular structure of the barrier wall in that design indeed reduces turbulence caused to the flame by gas flows to and from the adjacent ports. Such burner design with annular barrier wall performed satisfactorily when low-hydrogen fuel gas or natural gas is used as the fuel for the burner. However, it has been found that, when hydrogen-rich fuel gas is supplied to the burner resulting in higher flame temperature, the heat reflected by the annular barrier wall to the burner tip can be substantial enough to cause the burner tip to overheat, especially at turn-down of the burner and flame flash back, leading to premature failure of the burner tip.

In the burner-subsystem of the present invention, a non-annular barrier segment between the burner tip and the FGR duct opening is installed. It has been found that a partial barrier wall segment can be sufficient to block direct gas flow between the periphery of the tile enclosure and the FGR duct opening, preventing flame from entering the FGR duct, and achieving a sufficiently low NOx level in the exhaust. In addition, by employing only a segment of the barrier wall, the amount of heat reflected from the barrier wall to the burner tip can be reduced significantly, thereby reducing the burner tip temperature, preventing it from overheating especially during burner turn-down or fame flash back and premature failure. This design was found to be particularly advantageous in furnaces where hydrogen-rich flue gas is used, leading to prolonged burner tip life.

Thus, the barrier wall segment 60 in the burner sub-system of the present invention generally has a width resulting in an angle of view (alpha) no greater than 180° when viewed from the point where the vertical centerline of the burner tip intercepts the horizontal plane of the furnace floor segment. In general, alpha1≤alpha≤alpha2, where alpha1 and alpha2 can be, independently, 1, 3, 5, 10, 15, 20, 30, 40, 50, 60, 70, 80, 90, 100, 110, 120, 130, 140, 150, 160, 170, 180, as long as alpha1<alpha2.

Exemplary barrier wall segment 60 in the burner sub-system of the present invention blocks at least 50% (or at least 60%, 70%, 80%, 90%, 95%, or even 100%) of the line of sight of the FGR duct opening, when viewed from the point where the vertical centerline of the burner tip intercepts the plane of the furnace floor segment. Preferably, the center lines of the angles of view of the barrier wall segment and the FGR duct opening, when viewed from the point where the vertical centerline of the burner tip intercepts the horizontal plane of the furnace floor segment, are substantially adjacent to each other. Thus, the angle formed between the center lines of the these two angles of views is desired to be no higher than 30° (or no higher than 25°, 20°, 15°, 10°, 5°, 3°, or even) 1°.

Preferably, the angle of view of the barrier wall segment (alpha) is larger than the angle of view of the FGR duct opening (beta), when viewed from the point where the vertical centerline of the burner tip intercepts the plane of the furnace floor segment. Thus, $r1 \leq alpha/beta \leq r2$, where r1 and r2 can be, independently, 1.0, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, as long as $r1<r2$.

Exemplary barrier wall segment has a height of from h1 centimeters to h2 centimeters extending above the furnace floor segment plane, where h1 and h2 can be, independently, 2, 4, 6, 8, 10, 12, 14, 16, 18, 20, 22, 24, 26, 28, 30, 35, 40, 45, or 50, as long as $h1<h2$. It is desired that the area of the furnace floor segment between the periphery of the floor burner opening and the air ports 30 is substantially flat.

In certain preferred examples, the barrier wall may comprise a center portion and one or two support structure portion(s) 61 connected to the end of the center portion. The support structure portion(s) generally curve(s) away from the center of the floor burner opening. The support structure portion desirably has an average height lower than the center portion. The center portion may have a substantially uniform height, while the support structure portion may taper off from next to the center portion to the end thereof. The support structure portion can further deflect gas flow from the floor burner opening to the FGR duct opening, and provide mechanical support to the center portion. In a specific example, the barrier wall comprises a center portion blocking one side of a FGR duct opening, and two support structure portions blocking at least a portion of two other sides of the FGR duct opening. The barrier wall segment can be advantageously made from refractory materials such as ceramic, glass-ceramic, and the like.

Figure 5:
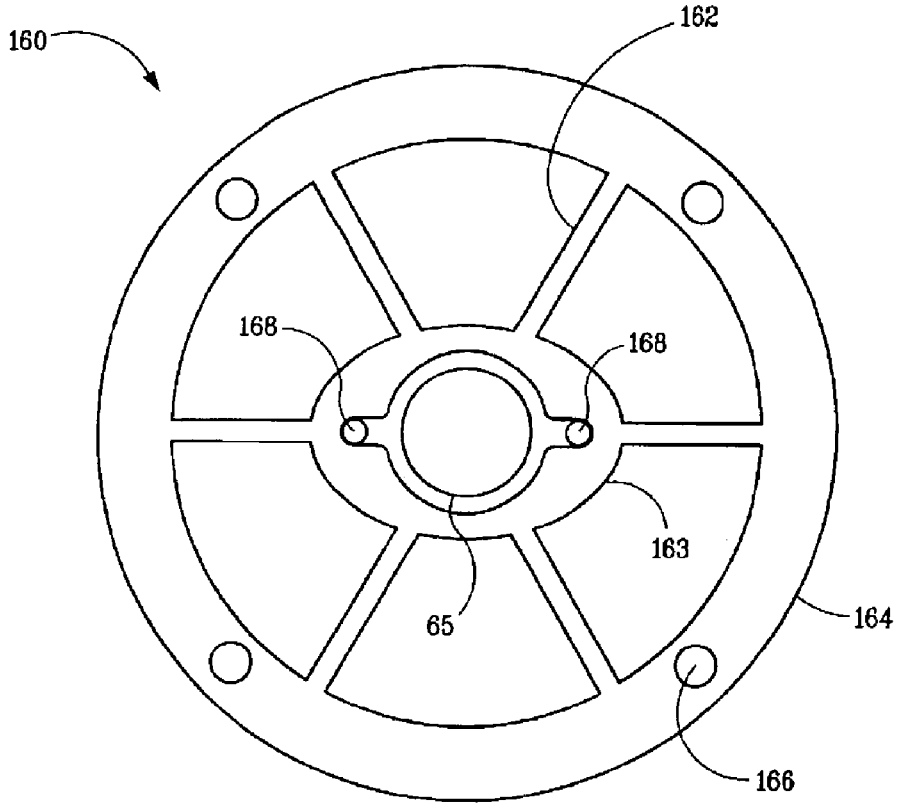
FIG. 5 is a top plan view of a centering plate useful in an example of the burner sub-system of the present invention.

The burner sub-system of the present invention may further include a centering plate as is now described with reference to FIGS. 1 and 5. Support members 161 suspend a perforated centering plate 160 from the roof of the primary air chamber 26. As shown in FIG. 5, a specific example of the perforated centering plate 160 has multiple spokes 162 interconnecting a riser centering member 163 and a peripheral ring support member 164. The riser centering member 163 is positioned about the gas riser 65 for maintaining the fuel orifice/gas spud in proper alignment with the inlet to the venturi portion 19. The ring member 164 has multiple holes 166 for use in securing the centering plate 160 to the support members 161.

In one specific example, centering plate 160 also contains a pair of holes 168 to permit a corresponding pair of steam injection tubes 15 to pass through centering plate 160 to the extent such steam injection tubes 15 are present.

As noted above, the centering plate 160 is perforated to permit flow therethrough of air from the primary air chamber 26, which avoids flow losses that result from a normally tortuous flow pattern caused by a presently used solid centering plate. These flow losses are avoided because the perforated centering plate design smoothes out the flow vectors entering the venturi portion 19 of the burner tube to enable higher venturi capacity, higher flue-gas recirculation rate, lower flame temperature and lower $NO_x$ production.

Although centering plate 160 as shown in FIG. 5 is illustrated as circular and although a circular shape is the preferred, it will be understood by those of skill in the art that the centering plate may be formed into many other shapes, including, for example, oval, square, or triangular without departing from the scope or spirit of the present invention.

Figure 3:
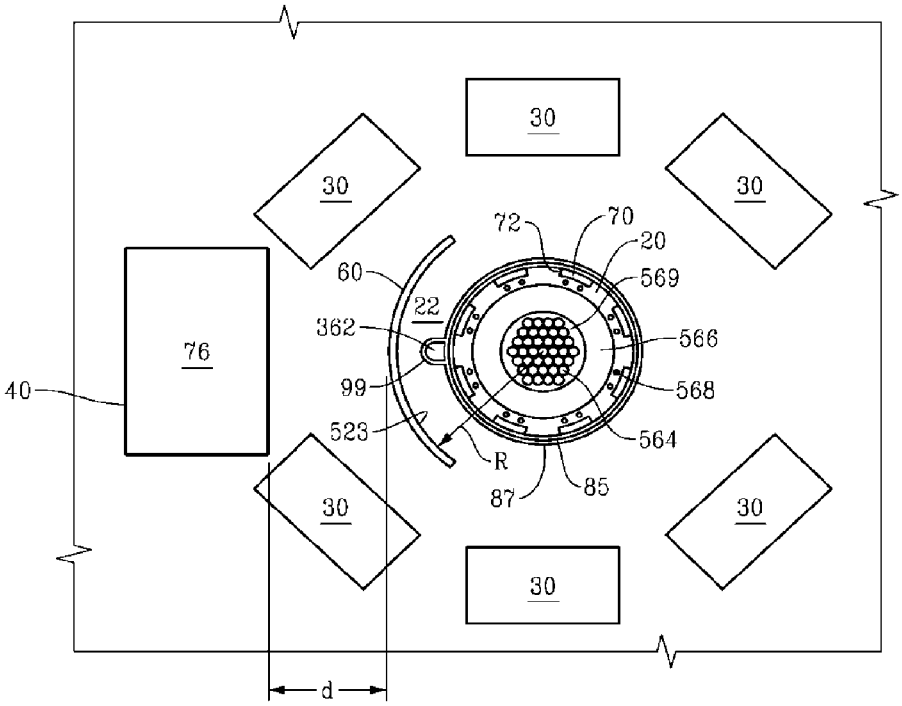
FIG. 3 is a plan view taken along line 3-3 of FIG. 1.
Figure 4:
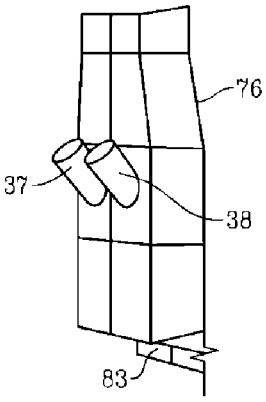
FIG. 4 is a perspective view of a specific example of a flue-gas recirculation duct useful in the burner sub-system in accordance with the present invention.
Figure 6A:
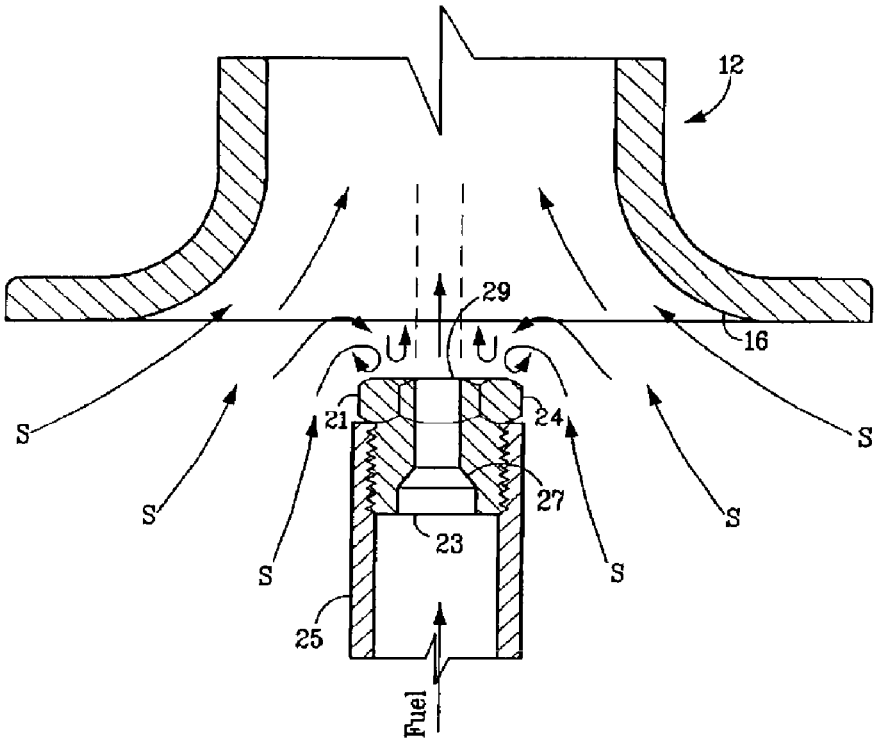
FIG. 6A is a cross-sectional view of a fuel spud useful in an example of the burner sub-system of the present invention.
Figure 6B:
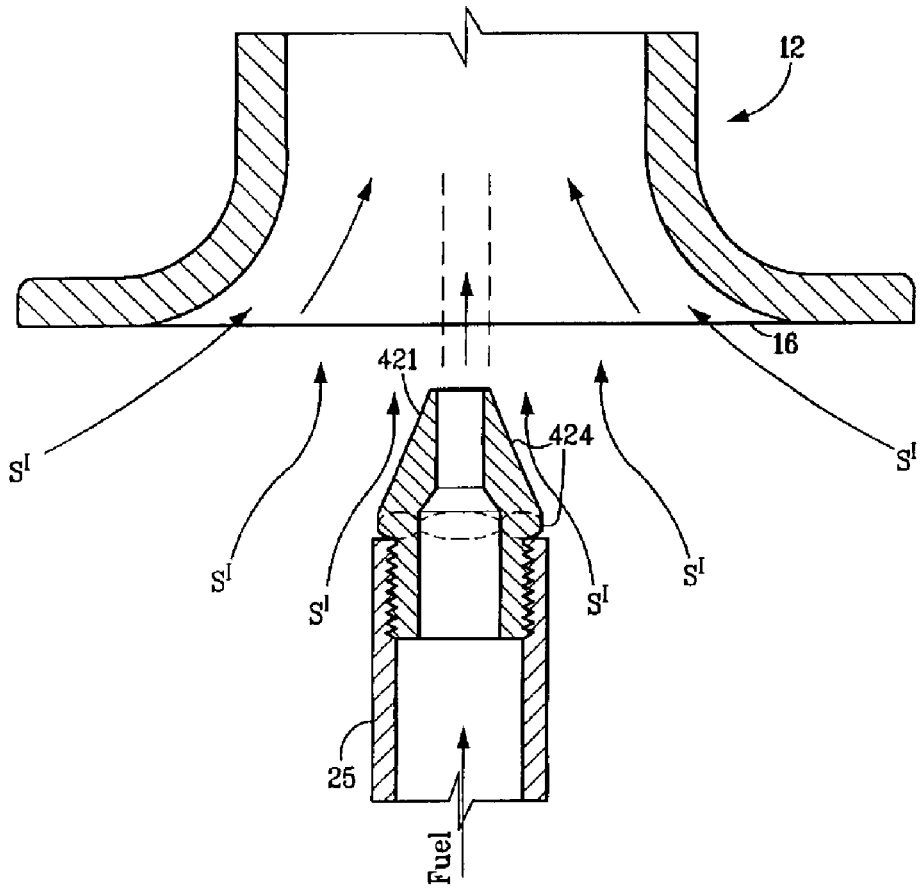
FIG. 6B is a cross-sectional view of another example of an improved fuel spud useful in an example of the burner sub-system of the present invention.

The burner useful in the sub-system of the present invention may employ an advantaged fuel spud as is now described with specific reference to FIG. 3, FIG. 6A and FIG. 6B. Referring now to FIG. 6A, a conventional fuel spud 24 is shown. Fuel spud 24 is affixed to the outlet end of fuel supply pipe 25, preferably by threads, as shown. Fuel spud 24 is aligned with the upstream end 16 of burner tube 12, so that fuel exiting the outlet end 29 of fuel spud 24 will flow into the upstream end 16 of burner tube 12, together with primary air and recirculated flue gas. As shown, the inner diameter of the inlet end 23 of fuel spud 24 transitions to a smaller diameter at outlet end 29 through the use of transition section 27. The outer surface 21 of fuel spud 24 is exposed to the venturi inlet flow stream, represented by streamlines S. Outer surface 21 is in the form of a hex-shaped nut, for ease in installation.

While outer surface 21 may be helpful in the installation of fuel spud 24, as is illustrated by streamlines S of FIG. 6A, when air is drawn into the venturi inlet 16, flow past the edges of fuel spud 24 can generate a zone of eddies and turbulence immediately adjacent to the highest velocity portion of fuel spud 24. The energy dissipated in this zone of eddies reduces the inspirating efficiency of the fuel spud 24 and burner tube 12 venturi combination. This inefficiency can limit the FGR ratio achievable in the burner.

FIG. 6B depicts a fuel spud 424, designed in accordance with another preferred form. As shown, fuel spud 424 employs a smoothly profiled outer surface 421, which takes the form of a frustum of a cone, to eliminate flow separation and eddies as the air and recycled flue gas pass over fuel spud 424 into upstream end 16 of burner tube 12. As schematically depicted by flow streamlines $S^i$, eddies and turbulence are minimized, thus improving the inspirating efficiency of the system. Use of this fuel spud design can improve the inspiration characteristics of the fuel spud/burner tube/venturi combination, increasing the ability to utilize higher levels of FGR and reduce $NO_x$ emissions.

Figure 8:
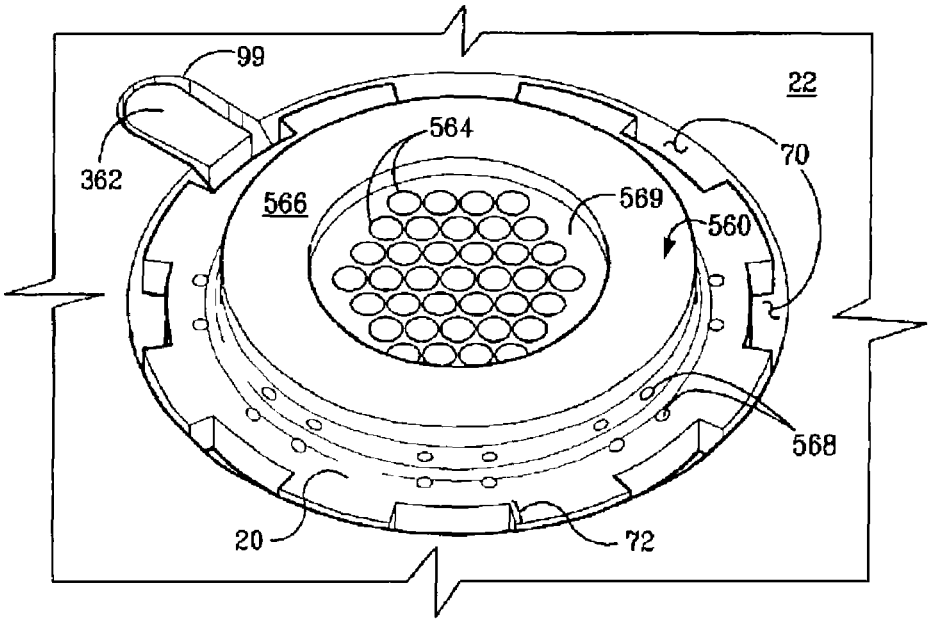
FIG. 8 is a perspective view of a burner tip useful in an example of the burner sub-system of the present invention.

An advantaged burner tip 20 useful in the burner sub-system of the present invention is now discussed with specific reference to FIGS. 1, 2, 3 and 8. A very small gap exists between the burner tip 20 and the burner tile enclosure 22. By precisely engineering this gap, the bulk of the secondary staged air is forced to enter the furnace through staged air ports 30 located some distance from the primary combustion zone, which is located immediately on the furnace side of the burner tip 20. This gap may be a single peripheral gap, or alternatively, comprise a series of spaced gaps 70 peripherally arranged, as shown in FIG. 8.

In connection with the advantaged burner spud 24 and burner tip 20 described above, the mixture of fuel, recirculated flue gas and primary air discharges from burner tip 20. The mixture in the venturi portion 19 of burner tube 12 is maintained below the fuel-rich flammability limit; i.e. there is insufficient air in the venturi to support combustion.

Staged, secondary air is added to provide the remainder of the air required for combustion. The majority of the staged air is added a finite distance away from the burner tip 20 through staged air ports 30. However a portion of the staged, secondary air passes between the burner tip 20 and the annular tile enclosure 22 and is immediately available to the fuel exiting the side ports 568 of burner tip 20. As indicated, side-ports 568 direct a fraction of the fuel across the face of the annular tile enclosure 22, while main ports 564, direct the major portion of the fuel into the furnace.

As may be envisioned, two combustion zones are established. A small combustion zone is established across the face of the peripheral tile enclosure 22, emanating from the fuel combusted in the region of the side ports 568, while a much larger combustion zone is established projecting into the furnace firebox, emanating from the fuel combusted from the main ports 564. In operation, the larger combustion zone represents an approximately cylindrical face of combustion extending up from the burner, where the staged air flowing primarily from air ports 30 meets the fuel-rich mixture exiting from the burner tip main ports 564.

The combustion zone adjacent to the side ports 568 and peripheral tile enclosure 22 contributes to flame stability. To provide adequate flame stability, the air/fuel mixture in this zone, which comprises the air/fuel mixture leaving the side ports 568 of burner tip 20, plus the air passing between the burner tip 20 and the peripheral tile enclosure 22, is desirably above the fuel-rich flammability limit.

While a mixture above the fuel-rich flammability limit in the combustion zone adjacent to the side ports 568 and peripheral tile enclosure 22 assures good burner stability, combustion in this zone tends to generate relatively high $NO_x$ levels compared to the larger combustion zone. Overall $NO_x$ emissions may be reduced by minimizing the proportion of fuel that is combusted in this smaller combustion zone. More particularly, in a staged-air, pre-mix burner employing integral flue-gas recirculation, when the quantity of fuel discharged into the combustion zone adjacent to side ports 568 and peripheral tile enclosure 22 does not exceed about 15% of the total fuel fired in the burner, lower overall $NO_x$ emissions are experienced. This is achieved by further assuring that the gas flow between burner tip 20 and the peripheral tile enclosure 22 is such that combustion takes place within this zone with a mixture sufficiently above the fuel-rich flammability limit to assure good burner stability, but without the high oxygen concentrations that lead to high $NO_x$ emissions.

The advantaged burner tip design described above limits the fuel discharged into the combustion zone adjacent to the side ports 568 and peripheral tile enclosure 22 to about eight percent of the total fuel. This design advantageously maintains the desired air/fuel ratio in this combustion zone, while maintaining a burner-tip-to-peripheral-tile enclosure gap of between about 0.15" to about 0.40". As shown, rather than have two rows of about thirty side ports, as is common in conventional designs, the advantaged burner tip 20 has two rows of 16 side ports 568, each side port having a diameter of about 6 mm. Advantageously, with this design, $NO_x$ emissions are reduced without the problems normally associated with reduced flame temperature and flame speed. The result is a very stable flame that is not prone to "lift-off" Reducing the diameter of the side ports 568 to about 5 mm also helps limit the fuel discharged into the combustion zone adjacent to the side ports 568 and peripheral tile enclosure 22 to between about 5 and 15 percent of the total fuel fired, while still producing a very stable flame.

In one example, burner tip 20 has an upper end 566 which, when installed, faces the burner box and a lower end adapted for mating with the downstream end 18 of burner tube 12. Mating of the lower end of burner tip 20 to the burner tube 12 can be achieved by swaging or, more preferably, by welding or threaded engagement.

Figure 9A:
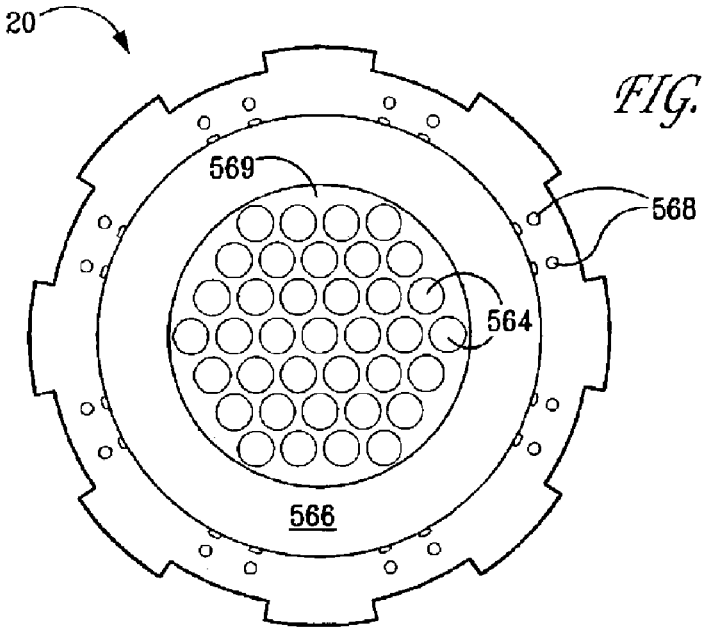
FIGS. 9A and 9B are plan views of the tip of a burner particularly useful in an example of the present invention and the tip of another, conventional burner, respectively.

Referring specifically to FIGS. 3, 8, and 9A, the upper end 566 of the burner tip 20 includes multiple main ports 564 in a centrally disposed end surface 569 and multiple side ports 568 in a peripheral side surface. In operation, the side ports 568 direct a portion of the fuel/air mixture across the face of the tile enclosure 22, whereas the main ports 64 direct the major portion of the mixture into the furnace.

Figure 9B:
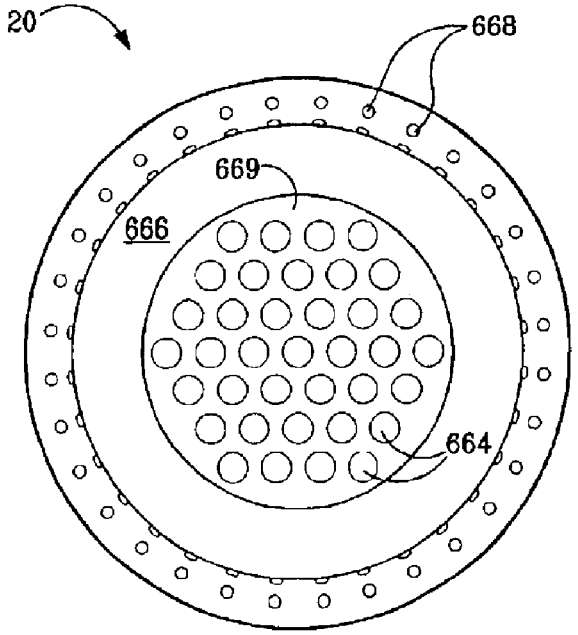
Figure 10A:
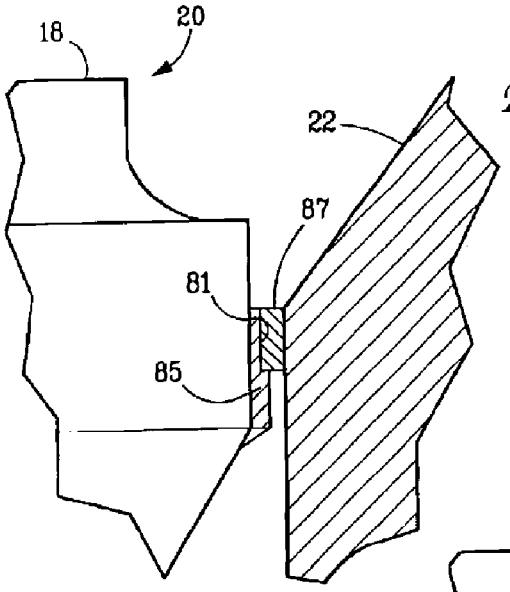
FIG. 10A is an exploded view of a burner tip seal useful in an example of the burner sub-system of the present invention.
Figure 10B:
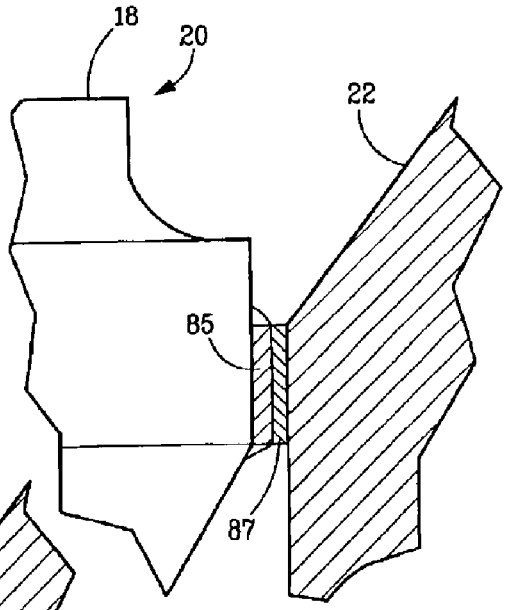
FIG. 10B is an exploded view of another burner tip seal useful in an example of the burner sub-system of the present invention.
Figure 10C:
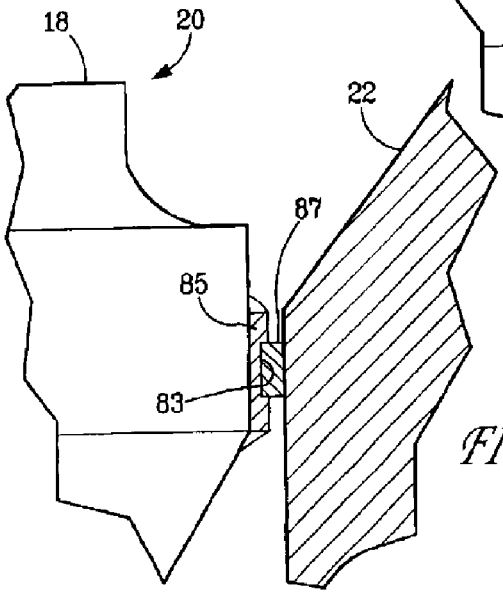
FIG. 10C is an exploded view of yet another burner tip seal useful in an example of the burner sub-system of the present invention.

Referring now to FIGS. 9A and 9B, the upper end 566 of the burner tip 20 of FIG. 1 is shown in FIG. 9A, whereas FIG. 9B shows the upper end 666 of a second, differing burner tip 20. Referring to FIG. 9A, it will be seen that the number and size of the main ports 564 in the centrally disposed end surface 569 of the burner tip 20 are significantly larger than those of the second tip. In particular, the number and dimensions of the main ports 564 in the tip of FIGS. 1 and 9A are such that the total area of the main ports 564 in the end surface 569 is at least 1 square inch, preferably at least 1.2 square inch, per million (MM) Btu/hr burner capacity. In contrast, in the second burner tip shown in FIG. 9B, the total area of the main ports 664 in the end surface 669 is less than 1 square inch per MMBtu/hr burner capacity. Referring again to FIG. 9A, in one practical example of a burner tip useful in the burner sub-system according to the invention, wherein the design firing rate of the burner is 6.0 MM Btu/hr, the total area of the main ports 564 in the end surface 569 is 8.4 $in^2$ whereas, in the second burner tip for use at the same design firing rate, the total area of these openings is only 5.8 $in^2$. The drop in tip velocity can be mitigated by the fact that raising tip flow area raises FGR. The increased total area of the main ports 564 in the burner tip 20 results in an increase in the flow area of the burner tip 20, which in turn enables higher FGR, rates to be induced without increasing the velocity for the fuel/air mixture flowing through the tip. In this way, stable operation of the burner can be retained with higher FGR rates.

The reduction in the number of side ports necessary to achieve a low NOx emissions level is dependent upon a number of factors including the properties of the fuel, itself, the dynamics of fluid flow and the kinetics of combustion. While the burner tips 20 described above having about a 53% reduction in the number of side ports, it would be expected that reductions in the number of side ports ranging from about 25% to about 75% could be effective as well, so long as each side port and the burner-tip-to-peripheral-tile enclosure gap is appropriately sized.

In the advantaged burner tip design described above, preferably the dimensions of the burner-tip-to-peripheral-tile enclosure gap are such that the total air available to the fuel gas exiting the side ports (i.e. the sum of air exiting the side ports with the fuel gas, plus the air supplied through gap), is between about 5 to about 15 percentage points above the Fuel Rich Flammability Limit for the fuel being used. For example, if the fuel being used has a Fuel Rich Flammability Limit of 55% of the air required for stoichiometric combustion, the air available to the fuel gas exiting the side ports desirably represents 60-65% of the air required for stoichiometric combustion.

Use of the advantaged burner tip described above serves to substantially minimize localized sources of high $NO_x$ emissions in the region near the burner tip.

Figure 7A:
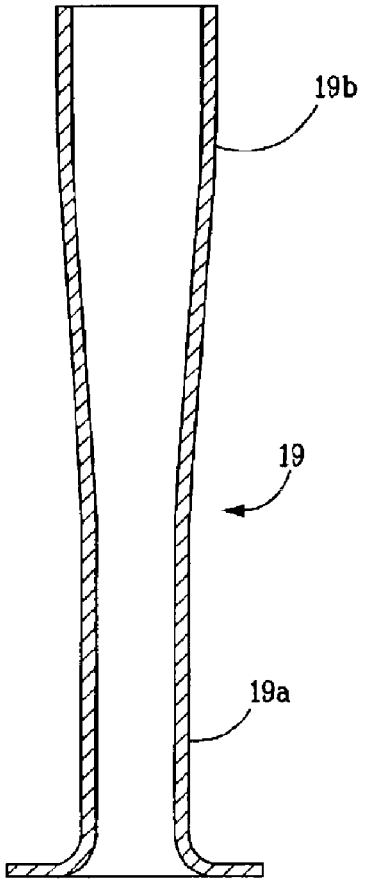
FIG. 7A and FIG. 7B are sectional views comparing, respectively the venturi of a conventional burner tube with the venturi of a burner tube particularly useful in an example of the burner sub-system of the present invention.
Figure 7B:
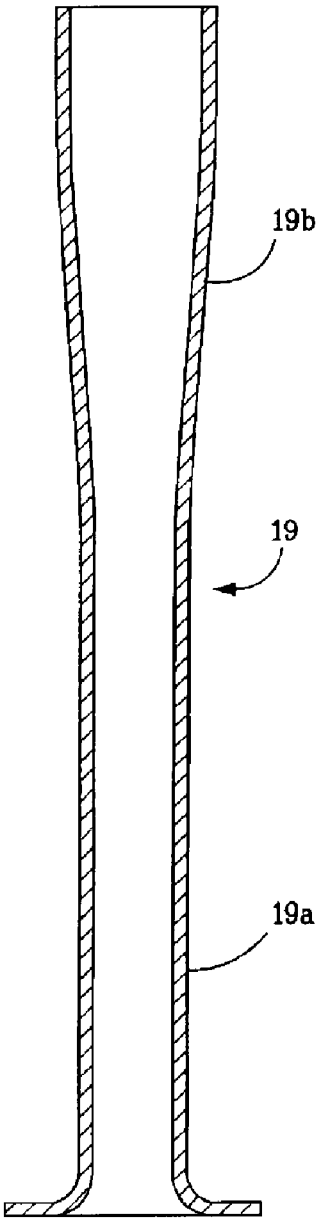

The burner 10 useful in the burner sub-system of the present invention may also comprise a venturi 19 as now discussed. Referring now to FIG. 7A, a venturi 19 of a conventional burner, of the type disclosed in U.S. Pat. No. 5,092,761, includes a relatively short throat portion 19*a* that is of substantially constant internal cross-sectional dimensions along its length and a divergent cone portion 19*b*, wherein the ratio of the length to maximum internal cross-sectional dimension of the throat portion 19*a* is less than 3, typically 2.6. As shown in FIG. 7B, a venturi of a burner tube of a burner useful in an advantaged burner-system of the present invention includes a throat portion 19*a* of substantially constant internal cross-sectional dimensions and a divergent cone portion 19*b*. However, the throat portion 19*a* of the burner is significantly longer than that of the conventional burner, as shown in FIG. 7A such that the ratio of the length to maximum internal cross-sectional dimension of the throat portion 19*a* is at least 3, preferably from about 4 to about 10, more preferably from about 4.5 to about 8, still more preferably from about 6.5 to about 7.5 and most preferably from about 6.5 to about 7.0. The internal surface of the throat portion 19*a* of the burner sub-system of the present invention is preferably cylindrical.

Increasing the ratio of length to internal cross-sectional dimensions in the throat portion of the venturi can reduce the degree of flow separation that occurs in the throat and cone portions of the venturi which increases the capacity of the venturi to entrain flue gas thereby allowing higher flue-gas recirculation rates and hence reduced flame temperature and $NO_x$ production. A longer venturi throat also promotes better flow development and hence improved mixing of the fuel gas/air stream prior to the mixture exiting the burner tip 20. Better mixing of the fuel gas/air stream also contributes to $NO_x$ reduction by producing a more evenly developed flame and hence reducing peak temperature regions.

The non-limiting burner 10 particularly useful in the burner sub-system of the present invention may include a lighting chamber arrangement as will now be discussed with particular reference to FIGS. 1, 3 and 8. Increasing the gap between the burner tip 20 and the burner tile enclosure 22 raises the overall $NO_x$ emissions produced by the burner, but also raises overall flame stability. The size of the gap is desirably sized such that it is small enough to minimize $NO_x$, and large enough to maintain adequate flame stability. In this regard, lighting chamber 99 may be seen to pose a problem. To substantially eliminate the effect on $NO_x$ emissions created by the presence of lighting chamber 99, which provides a significant cross-sectional flow area for additional air to pass, a removable lighting chamber plug 362 having a shape effective to substantially fill lighting chamber 99 when positioned within lighting chamber 99 is provided.

To operate the burner 10 useful in the burner-system of the present invention, a torch or igniter is inserted through light-off tube 50 into the lighting chamber 99, which is adjacent to the primary combustion area and burner tip 20, to light the burner. Following light-off, the lighting chamber 99 is plugged-off by inserting removable lighting chamber plug 362 through light-off tube 50 into the lighting chamber 99, for normal operation, eliminating the zone of high oxygen concentration adjacent to the primary combustion zone, and thus reducing the $NO_x$ emissions from the burner. For ease of installation, the lighting chamber plug 362 may be affixed to an installation rod, to form lighting chamber plug assembly 368, which is inserted through light-off tube 50 into lighting chamber 99. The use of the removable lighting chamber plug assembly 368 allows convenient attachment to the burner plenum through mechanical attachment of installation rod to burner plenum.

The removable lighting chamber plug 362 and assembly is advantageously constructed of materials adequate for the high temperature environment inside the furnace. The face 364 of the removable lighting chamber plug 362, which is the surface exposed to the furnace and which fits into burner tile enclosure 22, may be profiled to form an extension of the axi-symetric geometry of the burner tile enclosure 22, thus creating a flush mounting with the burner tile enclosure 22, as shown in FIG. 1. The lighting chamber plug 362 is constructed of a ceramic or high temperature refractory material suitable for temperatures in the range of from 2600 to 3600° F., as is typical for furnace burner tile enclosures. One material having utility in the practice of the present invention is a ceramic fiber blanket, such as Kaowool® Ceramic Fiber Blanket, which may be obtained from Thermal Ceramics Corporation of Atlanta, Ga., in commercial quantities. The burner plenum may be covered with mineral wool and wire mesh screening 52 to provide insulation therefor.

The burner 10 useful in the burner sub-system of the present invention may also include a tip seal arrangement as will now be discussed in connection with FIGS. 3, 8, 10A-10C, and 11. Increasing the available flow area of the gap between the burner tip 20 and the peripheral burner tile enclosure 22 raises the overall $NO_x$ emissions produced by the burner, although it tends to also benefit flame stability. In view of its impact on $NO_x$ emissions, each gap between the burner tip 20 and the burner tile enclosure 22 is carefully sized to maintain stability and minimize $NO_x$. The outer diameter of the burner tip 20 and the gas flow notches 70 can be manufactured to relatively tight tolerances through investment casting or machining. However, the peripheral tile enclosure 22 is more difficult to manufacture to the same tolerances, creating an unwanted gap between the outer diameter of the burner tip 20 and the peripheral tile enclosure 22. Typically, a peripheral tile enclosure is poured into a mold using a castable refractory material. Compounding the problem of producing peripheral burner tile enclosures to tight tolerances is the amount of shrinkage that the tile enclosures experience when dried and fired. The amount of shrinkage varies according to material, temperature, and geometry, causing additional uncertainties in the final manufactured tolerances. These factors contribute to the difficulty in consistently manufacturing a tile enclosure to a specified diameter, which can lead to a tile enclosure that is too small in diameter or, more commonly, one that is too large in diameter.

To establish a uniform dimension between the burner tip 20 and the peripheral burner tile enclosure 22 for the air gaps 70, a burner tip band 85, which may be formed of steel or other metal or metal composite capable of withstanding the harsh environment of an industrial burner, is attached to the outer periphery of burner tip 20, by tack welding or other suitable means. Advantageously, a compressible high temperature material 87 is optionally employed in the unwanted gap between the burner tip band 85 and the peripheral tile enclosure 22 to further reduce or eliminate the gap. Burner tip band 85 may further include a peripheral indentation 81 (see FIG. 10A) or peripheral indentation 83 (see FIG. 10C), respectively, for seating said compressible high temperature material. An advantage of this design is that the peripheral tile enclosure hole size can vary significantly, while the compressible material can adjusted for this variance in order to maintain the seal between the burner tip 20 and peripheral tile enclosure 22. By using this design of the burner sub-system, the air gap between the burner tip and peripheral tile enclosure can be maintained to exacting tolerances, essentially eliminating unwanted air leakage.

Compressible material 87 is desirably rated for high temperature service since it is very close to the burner side port flames. A material that expands when heated is very useful as compressible material 87 because it makes the initial installation much easier. Examples of suitable materials include, but are not limited to; Triple T™ by Thermal Ceramics and Organically Bound Maftec™ (OBM Maftec™) distributed by Thermal Ceramics of Atlanta, Ga., a division of Morgan Crucible. OBM Maftec™ is preferable since it held together better after being exposed to high temperatures. OBM Maftec™ is produced from high quality mullite fiber. This material is known to possess low thermal conductivity and heat storage and is resistant to thermal shock and chemical attack. It additionally is highly flexible, has a maximum temperature rating of 2900° F. and a continuous use limit of up to 2700° F., making it ideal for this application. While the Triple T™ material expands more than the Maftec™, it was found to flake apart more easily after heating.

Figure 11:
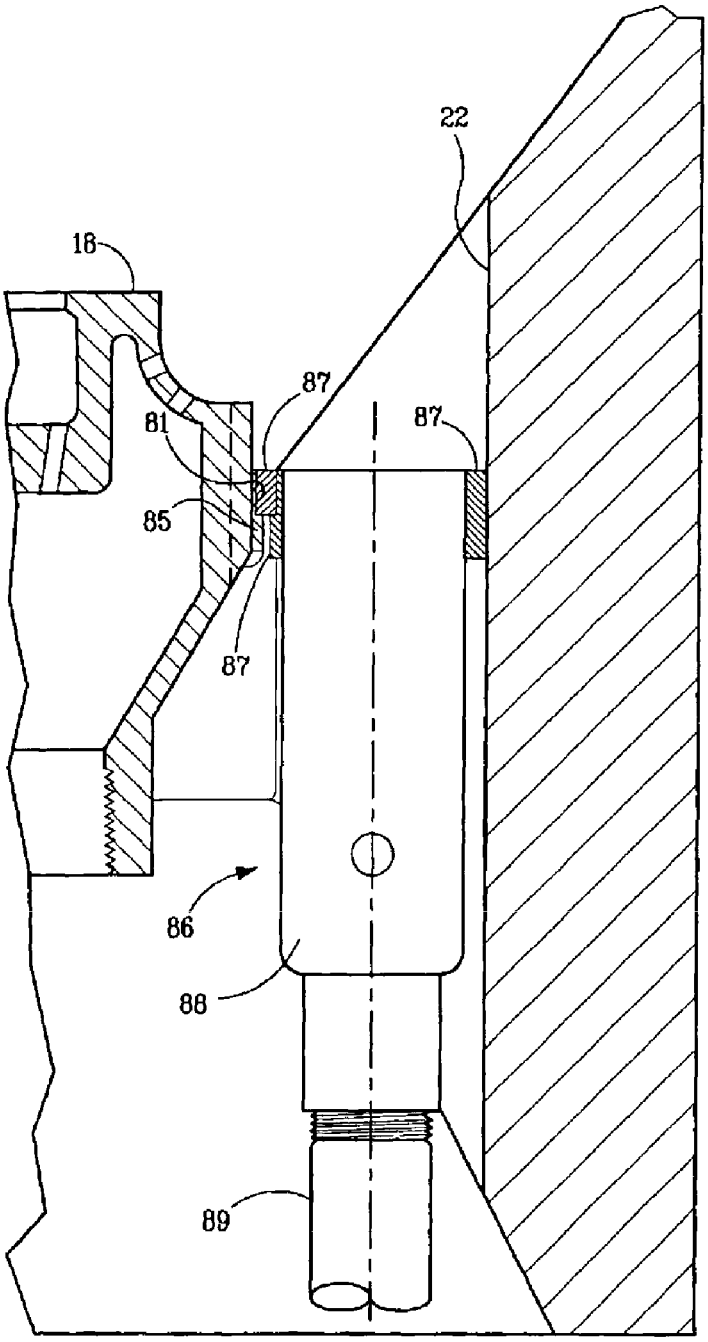
FIG. 11 illustrates an example of a seal means for sealing in the region of the pilot chamber useful in an example of the burner sub-system of the present invention.

Referring now to FIG. 11, a similar benefit may be obtained in the region of pilot 86, adjacent to the first opening in the furnace. Leakage can occur in typical designs due to gaps existing around the pilot shield 88. To remedy this, a compressible high temperature material 87 is installed around the pilot shield 88, and/or pilot riser 89 to eliminate the unwanted gap between the burner tip band 85 and the peripheral tile enclosure 22, as shown in FIG. 11. A one inch wide by 0.1875 inch thick strip of OBM Maftec™ works particularly well to seal gaps existing around the pilot shield 88.

Figure 2:
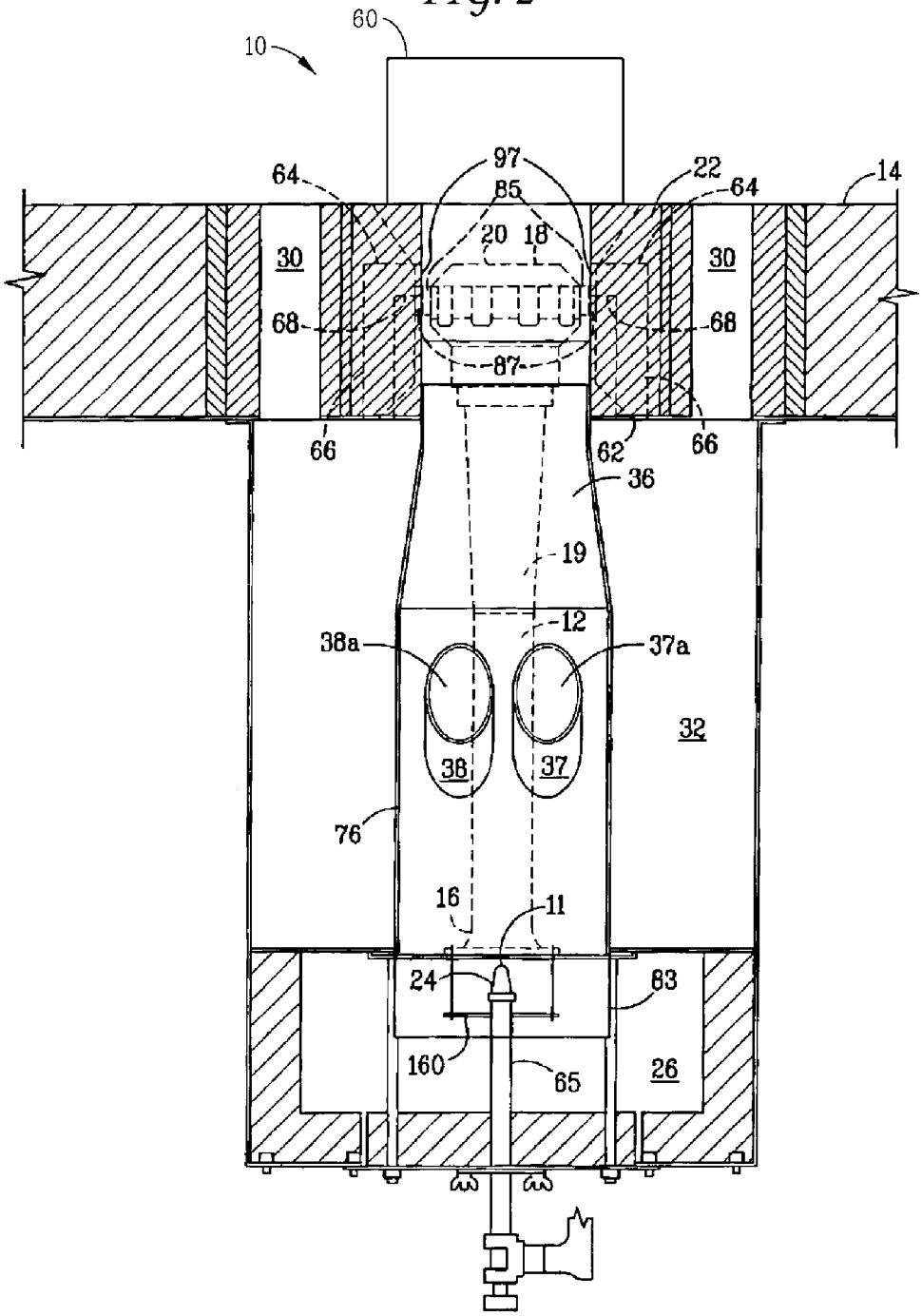
FIG. 2 is an elevation partly in section taken along line 2-2 of FIG. 1.

The burner sub-system of the present invention also comprises a FGR duct, which may be angled, as next discussed in connection with FIGS. 1-3. The FGR duct 76 angles outwardly at 84 such that the FGR duct opening 40 of the duct 76 is physically further spaced away from the base of the burner tip 20. The angled FGR duct inlet 84 thus avoids or at least reduces the potential for the burner flame to be entrained into the FGR duct 76. This design enables higher flue-gas recirculation (FGR) rates to be induced into the burner 10. Such higher FGR rates, in turn, reduce overall flame temperature and NOx production.

With reference to the non-limiting example shown in FIG. 3, a flame opening 523 is circular and has a radius R, and the distance (d) that the duct opening 40 is laterally spaced from the flame opening 523 is defined by $d \geq 0.5$ R for avoiding entrainment of the flame into the duct opening 40.

Referring again to FIG. 1, the angle outward at 84 also permits the continued use of the relatively small burner box. Such FGR burners may be desirably in the order of 6 feet in height by 3 feet in width.

In addition to the use of flue gas as a diluent, another technique to achieve lower flame temperature through dilution is through the use of steam injection. Steam can be injected in the primary air or the secondary air chamber. Preferably, steam may be injected upstream of the venturi.

Figure 13:
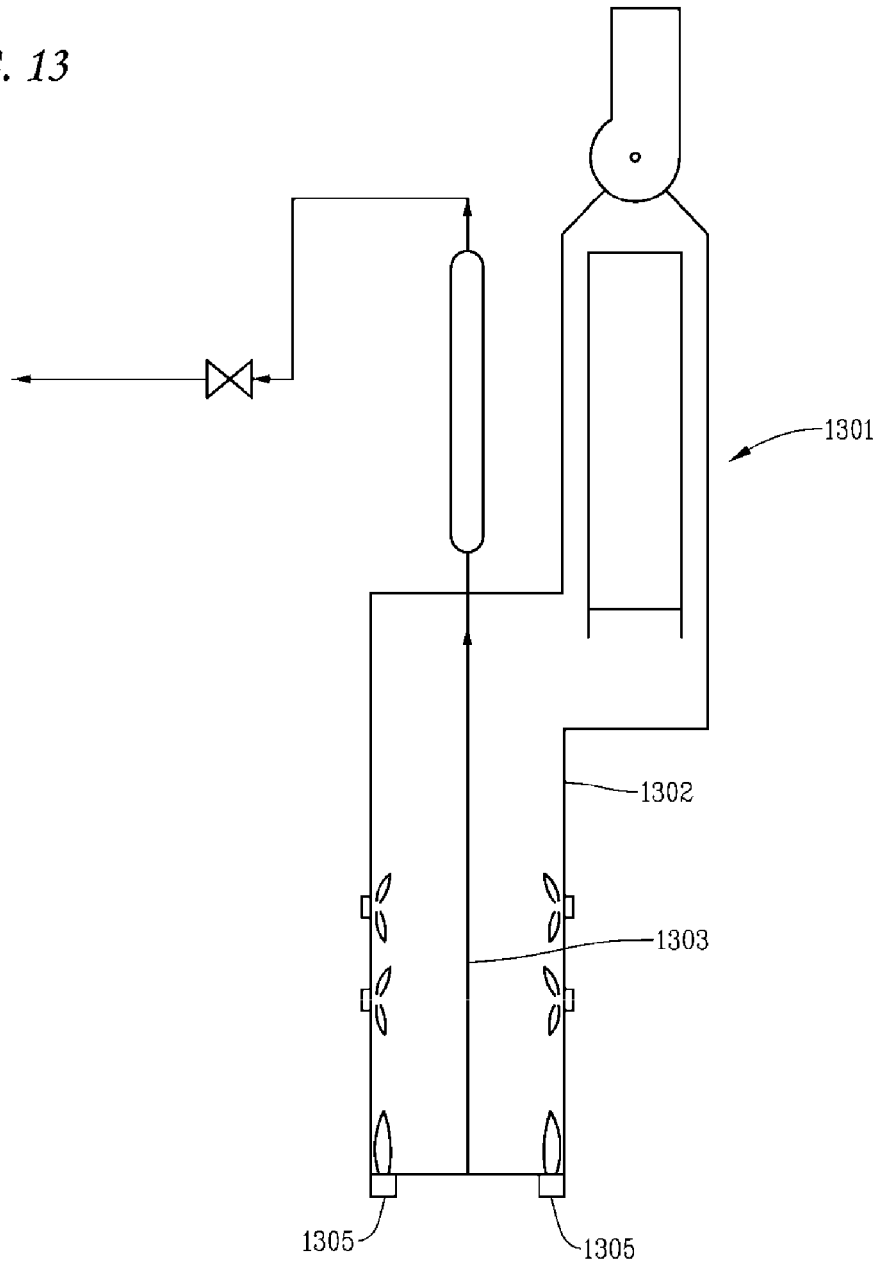
FIG. 13 is a schematic illustration showing an example of a furnace of the present invention comprising multiple side wall burners mounted on side walls.

FIG. 13 is a schematic illustration of a steam cracking furnace 1301 for producing olefins from hydrocarbon feeds in operation. The furnace 1301 comprises a radiant firebox defined by a furnace floor and multiple furnace side walls, in which a radiant tube 1303 is being heated by multiple floor-firing flames produced by burner sub-systems 1305 and multiple wide wall burner flames produced by side wall burners installed in the side walls. The side wall burner flames can be advantageously close to the side wall surface, providing thermal inputs conducive to a reduced level of NOx emissions form the furnace. A hydrocarbon reactant stream flowing through tube 1303 undergoes thermal cracking reactions to produce olefins.

Figure 14:
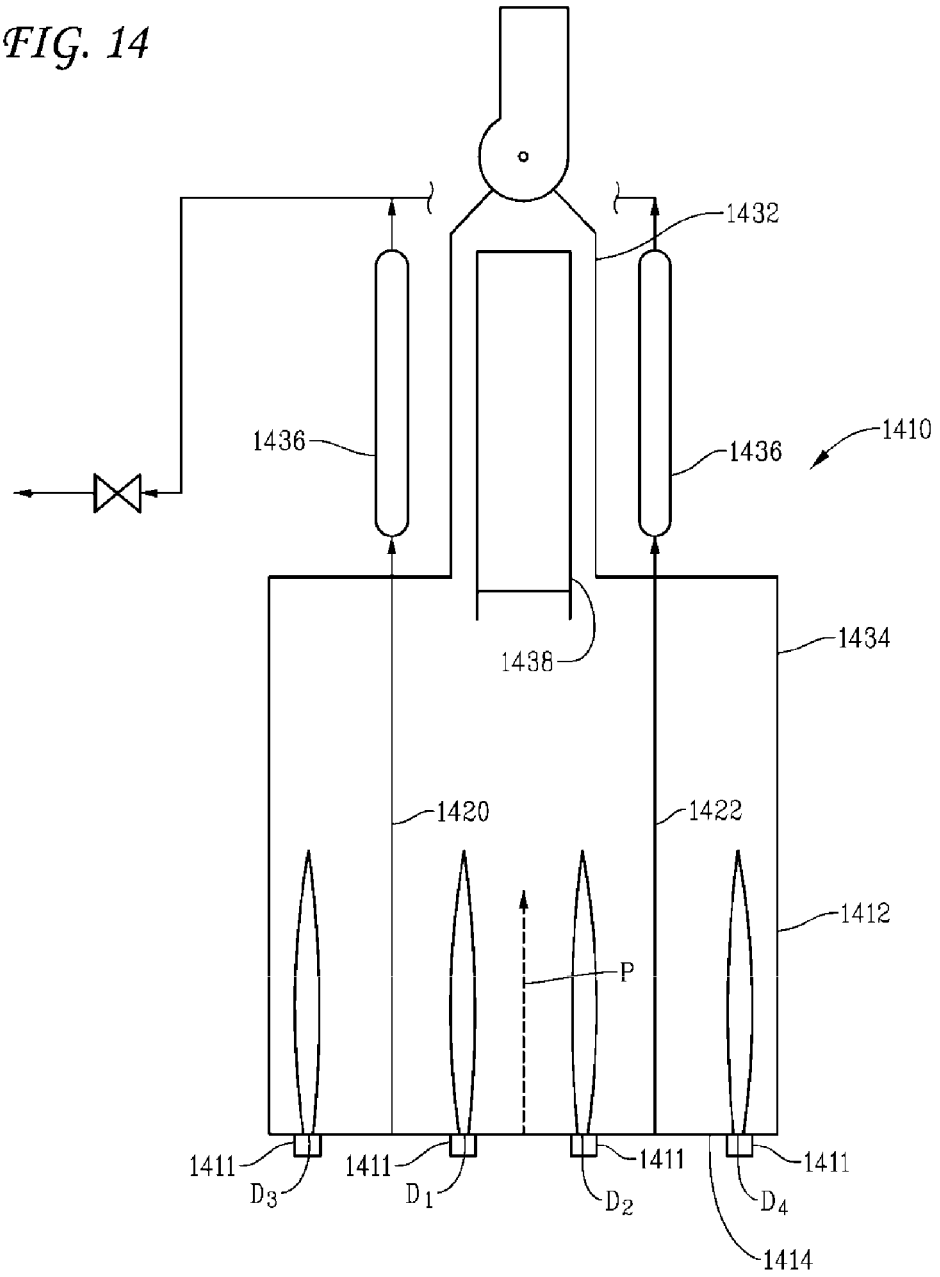
FIG. 14 is a schematic illustration showing an example of a furnace of the present invention without a side wall burner mounted on side walls.
Figure 15:
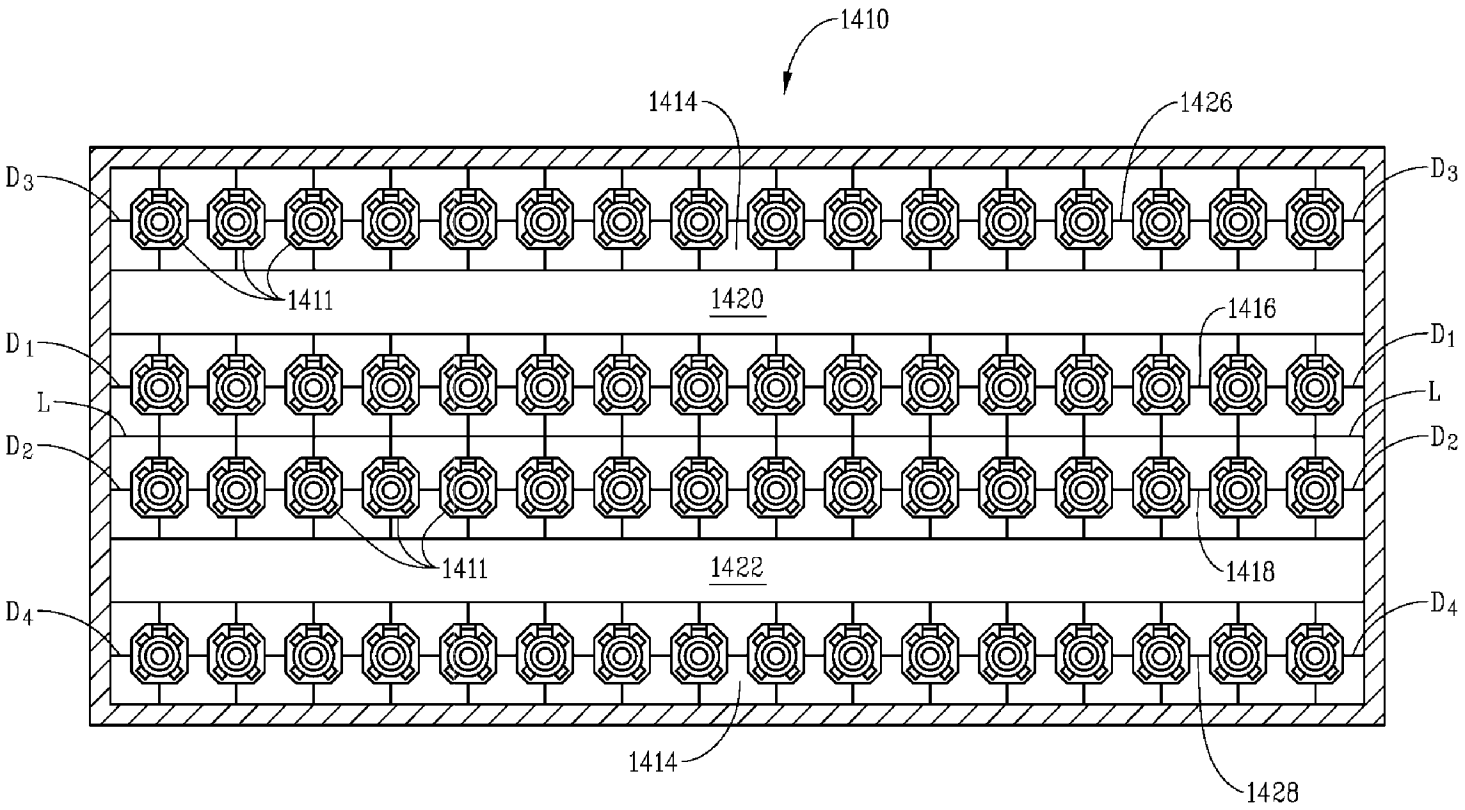
FIG. 15 is a plan view of an example of a furnace of the present invention without a separation wall between adjacent rows of burners.

Referring now to FIGS. 14 and 15, a non-limiting example of furnace 1410 is illustrated, which can be used in the production of ethylene from ethane. Furnace 1410 includes a radiant firebox 1402 having a furnace floor 1414 having a centerline L and multiple side walls. Centerline L may be of a width of about a foot or less, for the purposes of the instant disclosure. Multiple floor burners 1411 are arranged along two parallel lines $D_1$ and $D_2$ to form a first line of burners 1416 and a second line of burners 1418, each line of burners spaced a substantially equal distance from the centerline L of furnace floor 1414 and on opposing sides of the centerline L. The non-limiting exemplary furnace 1410 does not use side burner flames produced from side wall burners located on the side walls.

A first plane of radiant coils 1420 is arranged parallel to a plane P passing through the centerline L of the furnace floor 1414 and perpendicular to the furnace floor 1414. First plane of radiant coils 1420 is spaced at a distance greater than the distance that the first line of burners 1416 is spaced from the centerline L of the furnace floor 1414 and on the same side of the centerline L as the first row of burners 1416. A second plane of radiant coils 1422 is arranged parallel to plane P passing through the centerline L of furnace floor 1414 and perpendicular to furnace floor 1414. Second plane of radiant coils 1422 is spaced at a distance greater than the distance that the second line of burners 1418 is spaced from the centerline L of furnace floor 1414 and on the same side of the centerline L as the second row of burners 1418.

In one form, furnace 1410 may also include a second plurality of burners 1411 arranged along at least two parallel lines $D_3$ and $D_4$ to form a third line of burners 1426 and a fourth line of burners 1428, each line of burners spaced a substantially equal distance from the centerline L of the furnace floor 1414 at a distance greater than the distance that the first plane of radiant coils 1420 and the second plane of radiant coils 1422 are spaced from the centerline L of the furnace floor 1414, respectively.

In operation of furnace 1410, hydrocarbon feed is first preheated and, in the case of liquid feeds commonly at least partially vaporized, and mixed with dilution steam in the convection section 1432 of furnace 1410. The temperature exiting convection section 1432 is generally designed to be at or near the point where significant thermal cracking commences. Typically, for example, this temperature is about 1050° F. (565° C.) to about 1150° F. (620° C.) for gas-oil feeds, about 1150° F. (620° C.) to about 1250° F. (675° C.) for naphtha feeds, and about 1250° F. (675° C.) to about 1350° F. (730° C.) for ethane feed. After preheating in convection section 1432, a vapor feed/dilution steam mixture is typically rapidly heated in the radiant section 1434 to achieve the desired level of thermal cracking. The coil outlet temperature (COT) of radiant section 1434 commonly can be in the range of from 1450° F. (790° C.) to about 1500° F. (815° C.) for gas oil feeds, about 1500° F. (815° C.) to about 1600° F. (870° C.) for naphtha feeds, and about 1550° F. (845° C.) to about 1650° F. (900° C.) for ethane feeds. After the desired degree of thermal cracking has been achieved in radiant section 1434, the furnace effluent is rapidly quenched in either an indirect heat exchanger 1436 and/or by the direct injection of a quench fluid stream (not illustrated).

In various examples, the plurality of burners 1411 of furnace 1410 may include raw gas burners, staged-fuel burners, staged air burners, premix staged air burners or combinations thereof. In another form the plurality of burners 1411 of furnace 1410 may include premix staged air burners and optionally with combinations including the preceding listed burners. Examples of premix staged air burners may be found in U.S. Pat. Nos. 4,629,413; 5,092,716, and 6,877,980, the contents of which are hereby incorporated by reference in their entirety. With burners of these types, tall flames are produced and commercial experience has confirmed there is no need for supplementary wall mounted burners. While the third line of burners 1426 and the fourth line of burners 1428 may of the same type as the first line of burners 1416 and the second line of burners 1418, flat-flame burners may be employed the third line of burners 1426 and the fourth line of burners 1428. As those skilled in the art will readily understand, a flat-flame burner is one that is typically stabilized, at least in part, by the furnace wall.

Highly stable flames with a tall height can be achieved by using the burner sub-system of the present invention. Thus it is highly desirable that the furnace firebox has a height of at least 8.0, 8.5, 9.0, 9.5, 10.0, 10.5, 11.0, 11.5, 12.0, 12.5, 13.0, 13.5, 14.0, 14.5, 15.0, 15.5, or even 16.0 meters. The tall walls of the furnace enable tall, stable flames having a height H(f) with a height in the range from Hf(1) to Hf(2), where Hf(1) and Hf(2) can be, independently, 3.0, 3.5, 4.0, 4.5, 5.0, 5.5, 6.0, 6.5, 7.0, 7.5, 8.0, 8.5, 9.0, 9.5, or even 10.0, as long as Hf(1)<Hf(2).

It is desired that the distance of the vertical centerline of any burner tip to any side wall is at least 30, 35, 40, 45, 50, 55, 60, 65, 70, 75, 80, 85, 90, 95, or 100 centimeters. Such relatively large distance between the flame and the side wall reduces the erosion of the side wall.

Because the stability of the flames achievable by the burner sub-system of the present invention, it is desirable that in certain examples, there is no intermediate partitioning wall between adjacent burner sub-systems. The burner sub-system enables large furnaces housing multiple rows of burners providing multiple flames capable of heating cracking tubes installed in between to the desired temperature ranges with the desired level of temperature variation. Side wall burner flames produced by side wall burners installed on the side walls of the furnace firebox may be eliminated, substantially reducing the overall cost of the furnace.

Although the burner sub-system, the furnace, and the processes of this invention have been described in connection with floor-fired hydrocarbon cracking furnaces, they may also be used in furnaces for carrying out other reactions or functions.

It will also be understood that the teachings described herein also have utility in traditional raw gas burners and raw gas burners having a pre-mix burner configuration wherein flue gas alone is mixed with fuel gas at the entrance to the burner tube.

Thus, it can be seen that, by use of this invention, burner tip can avoid premature failure due to overheating caused by reflection from the barrier wall, especially where hydrogen-rich fuel gas is used. In addition, $NO_x$ emissions may be reduced without the use of fans or otherwise special burners.

Although the invention has been described with reference to particular means, materials and embodiments, it is to be understood that the invention is not limited to the particulars disclosed and extends to all equivalents within the scope of the claims.

Thus, non-limiting aspects and embodiments of the present invention include:

A1. A burner sub-system comprising:

(a1) a furnace floor segment having a floor burner opening and a flue-gas recirculation duct opening;

(a2) a tile enclosure lining the periphery of the floor burner opening;

(a3) a burner comprising a burner tip adjacent and surrounded by the floor burner opening, the burner tip having a vertical centerline and configured to provide a floor burner flame through the floor burner opening;

(a4) a flue-gas recirculation duct opening adjacent the tile; and (a5) a barrier wall segment extending upwards from the upper surface of the furnace floor segment between the flue-gas recirculation duct opening and the burner tip, the barrier wall segment having an angle of view no greater than 180° when viewed from the point where the vertical centerline of the burner tip intercepts a plane of the furnace floor segment.

A2. The burner sub-system of A1, wherein the barrier wall segment has an angle of view no more than 90° when viewed from the point where the vertical centerline of the burner tip intercepts a plane of the furnace floor segment.

A3. The burner sub-system of A1 or A2, wherein the barrier wall segment blocks at least 50% of the line of sight of the flue-gas recirculation duct opening when viewed from the point where the vertical centerline of the burner tip intercepts the plane of the furnace floor segment.

A4. The burner sub-system of any of A1 to A3, wherein the barrier wall segment completely blocks the line of sight of the flue-gas recirculation duct opening when viewed from the point where the vertical centerline of the burner tip intercepts the plane of the furnace floor segment.

A5. The burner sub-system of any of A1 to A4, wherein the barrier wall segment has a height of from 2 centimeters to 50 centimeters (or 45, 40, 35, 30, 25, or 20 centimeters) above the upper surface of the furnace floor segment.

A6. The burner sub-system of any of A1 to A5, wherein the barrier wall segment has a center portion and at least one support structure portion connected to the center portion, and the support structure portion is optionally curved away from the center of the floor burner opening.

A7. The burner sub-system of A6, wherein the center portion is taller than the support structure portions.

A8. The burner sub-system of A6 or A7, wherein the barrier wall segment at least partly encloses the outer periphery of the flue-gas recirculation duct opening.

A9. The burner sub-system of A8, wherein the barrier wall segment at least encloses a portion of three sides of the outer periphery of the flue-gas recirculation duct opening.

A10. The burner sub-system of any of the preceding claims, wherein:

the burner comprises a burner tube having an upstream end, a downstream end, and a venturi intermediate the upstream end and the downstream end; and the burner tip is mounted on the downstream end.

B1. A furnace comprising:

(b1) at least one burner sub-system according to any of the claims of A1-A10;

(b2) a furnace floor comprising the furnace floor segment of each of the at least one burner sub-system; and (b3) one or more furnace side walls; wherein the furnace floor and the one or more furnace side walls form a furnace fire box.

B2. The furnace of B1, wherein the distance from the vertical centerline of any burner tip to any side wall is at least 30 centimeters.

B3. The furnace of B1 or B2, which comprises multiple burner sub-systems and is free of any partitioning wall between adjacent burner sub-systems.

B4. The furnace of any of B1 to B3, wherein the fire box has a height of at least 10.5 meters.

B5. The furnace of any of B1 to B4, wherein the fire box has a height of at least 15.0 meters.

B6. The furnace of any of B1 to B5, further comprising multiple side wall burners configured to produce a side wall burner flame from at least one of the furnace side walls.

B7. The furnace of any of B1 to B5, which is free of a side wall burner configured to produce a side wall burner flame from any of the furnace side wall.

B8. The furnace of any of B1 to B7, comprising at least three burner sub-systems configured to produce at least two rows of floor burner flames projecting upwards.

C1. A fuel combustion process carried out in a furnace according to any of B1 to B8, the process comprising:

(c1) supplying a fuel gas comprising at least 50 mol % of hydrogen into the at least one burner sub-system; and (c2) combusting the fuel gas to form a floor burner flame above the burner tip inside the furnace fire box.

C2. The fuel combustion process of C1, wherein the floor flame has a height of at least 3.0 meters, preferably at most 7.5 meters.

C3. The fuel combustion process of C1 or C2, wherein the distance from the vertical centerline of any floor burner flame to any side wall is at least 30 centimeters.

C4. The fuel combustion process of any of C1 to C3, which comprises multiple floor burner flames and is free of any partitioning wall between adjacent floor burner flames.

C5. The fuel combustion process of any of C1 to C4, further comprising multiple side wall burner flames produced by multiple side wall burners from at least one of the furnace side walls.

C6. The fuel combustion process of any of C1 to C5, which comprises at least two rows of floor burner flames.

D1. A steam cracking process comprising a fuel combustion process of any of C1 to C6, wherein a reactant stream comprising a hydrocarbon is heated inside a cracking tube which is heated inside the furnace by the flame.

D2. The steam cracking process of D1, wherein the reactant stream comprises ethane in the reactant steam.

D3. The cracking process of D1 or D2, wherein molecular hydrogen is produced in the cracking tube, and at least a portion of the molecular hydrogen constitutes at least a portion of the fuel gas.

The invention claimed is:

1. A furnace:

(A) a burner sub-system comprising:

a furnace floor segment having a floor burner opening and a flue-gas recirculation duct opening;

a tile enclosure lining the periphery of the floor burner opening, wherein the flue gas recirculation duct opening is adjacent the tile enclosure;

a burner comprising a burner tip adjacent and surrounded by the floor burner opening, the burner tip having a vertical centerline and configured to provide a floor burner flame through the floor burner opening; and a barrier wall segment extending upwards from the upper surface of the furnace floor segment between the flue-gas recirculation duct opening and the burner tip, the barrier wall segment having an angle of view no greater than 180° when viewed from the point where the vertical centerline of the burner tip intercepts a plane of the furnace floor segment, wherein the barrier wall segment comprises a center portion and a first support structure portion connected to a first end of the center portion, wherein the first support structure portion extends upwards from the upper surface of the furnace floor segment;

(B) a furnace floor comprising the furnace floor segment of each of the at least one burner sub-system; and (C) one or more furnace side walls;

wherein the furnace floor and the one or more furnace side walls form a furnace fire box.

2. The furnace of claim 1, wherein the distance from the vertical centerline of any burner tip to any side wall is at least 30 centimeters.

3. The furnace of claim 1, which comprises multiple burner sub-systems and is free of any partitioning wall between adjacent burner sub-systems.

4. The furnace of claim 1, wherein the fire box has a height of at least 10.5 meters.

5. The furnace of claim 1, wherein the fire box has a height of at least 15.0 meters.

6. The furnace of claim 1, further comprising multiple side wall burners configured to produce at least one side wall burner flame from at least one of the furnace side walls.

7. The furnace of claim 1, which is free of a side wall burner configured to produce a side wall burner flame from any of the furnace side wall.

8. The furnace of claim 1, comprising at least three burner sub-systems configured to produce at least two rows of floor burner flames projecting upwards.

9. A fuel combustion process carried out in a furnace according to claim 1, the process comprising:

supplying a fuel gas comprising at least 50 mol % of hydrogen into the at least one burner sub-system; and combusting the fuel gas to form a floor burner flame above the burner tip inside the furnace fire box.

10. The fuel combustion process of claim 9, wherein the floor flame has a height of at least 3.0 meters.

11. The fuel combustion process of claim 9, wherein the distance from the vertical centerline of any floor burner flame to any side wall is at least 30 centimeters.

12. The fuel combustion process of claim 9, which comprises multiple floor burner flames and is free of any partitioning wall between adjacent floor burner flames.

13. The fuel combustion process of claim 9, further comprising multiple side wall burner flames produced by multiple side wall burners from at least one of the furnace side walls.

14. The fuel combustion process of claim 9, which comprises at least two rows of floor burner flames.

15. A steam cracking process comprising a fuel combustion process of claim 9, wherein a reactant stream comprising a hydrocarbon is heated inside a cracking tube which is heated inside the furnace by the floor burner flame.

* * * * *